US011585103B2

(12) United States Patent
Raudies et al.

(10) Patent No.: US 11,585,103 B2
(45) Date of Patent: Feb. 21, 2023

(54) MOUNTING HEAD WITH ANCHORING CROSS-MEMBER AND CEILING FORMWORK SYSTEM CONNECTED THERETO

(71) Applicant: PERI SE, Weissenhorn (DE)

(72) Inventors: Thomas Raudies, Ehingen (DE); Wilfried Haeberle, Langenau (DE); Stefanie Dietrich, Ulm (DE); Gisbert Eppelt, Pfaffenhofen (DE)

(73) Assignee: PERI SE, Weissenhorn (DE)

( * ) Notice: Subject to any disclaimer, the term of this patent is extended or adjusted under 35 U.S.C. 154(b) by 0 days.

(21) Appl. No.: 16/524,057

(22) Filed: Jul. 27, 2019

(65) Prior Publication Data

US 2021/0025183 A1 Jan. 28, 2021

(30) Foreign Application Priority Data

Jul. 27, 2019 (DE) ..... 10 2018 118 230.9

(51) Int. Cl.
*E04G 11/48* (2006.01)
*E04G 11/38* (2006.01)
*E04G 11/50* (2006.01)

(52) U.S. Cl.
CPC ..... *E04G 11/48* (2013.01); *E04G 11/38* (2013.01); *E04G 11/483* (2013.01); *E04G 11/50* (2013.01)

(58) Field of Classification Search
CPC ..... E04G 11/36; E04G 11/38; E04G 11/48; E04G 11/50; E04G 11/483; E04G 11/486
See application file for complete search history.

(56) References Cited

U.S. PATENT DOCUMENTS 1,415,554 A * 5/1922 Hatch ..... E04G 11/50 52/645
1,498,665 A * 6/1924 MacIvor ..... E04G 11/48 249/18
1,719,528 A * 7/1929 Beckley ..... E04G 25/065 248/357
6,643,931 B2 * 11/2003 Nees ..... B21C 37/0803 29/414

FOREIGN PATENT DOCUMENTS

CA 2687832 A1 * 12/2008 ..... E04G 11/50
CN 109667418 * 4/2019 ..... E04G 11/38
DE 3215002 A1 * 10/1983 ..... E04G 11/486
DE 3515322 A * 10/1986 ..... E04G 11/38
DE 102007008209 A1 * 8/2008 ..... E04G 11/38
DE 102016204633 A1 * 9/2017 ..... E04G 11/50
EP 1398432 * 3/2004 ..... E04G 11/38
EP 3202998 A1 * 8/2017 ..... E04G 11/38
(Continued)

*Primary Examiner* — Michael Safavi
(74) *Attorney, Agent, or Firm* — Wei & Sleman LLP

(57) ABSTRACT

A ceiling formwork system having a formwork panel which may be placed on at least one vertical support via a mounting head. The mounting head has an anchoring cross-member which in the mounted state on the vertical support is oriented transverse thereto, the length of the anchoring cross-member corresponding to at least one side length of the ceiling formwork panel to be supported, whereby the anchoring cross-member is respectively affixable at its ends to lateral edges of the ceiling formwork panel.

17 Claims, 4 Drawing Sheets

(56) References Cited

FOREIGN PATENT DOCUMENTS

| | | | | | |
|---|---|---|---|---|---|
| FR | 3041010 | A1 | * | 3/2017 | E04G 17/002 |
| KR | 100845459 | | * | 7/2008 | E04G 13/04 |
| KR | 2010010986 | A | * | 2/2010 | E04G 11/38 |
| KR | 1020120064657 | | * | 6/2012 | E04G 11/38 |
| KR | 101586975 | | * | 2/2016 | E04G 11/48 |
| WO | WO-0019038 | A1 | * | 4/2000 | E04G 11/48 |
| WO | WO-2015015026 | A1 | * | 2/2015 | E04G 11/48 |
| WO | WO-2015196264 | A1 | * | 12/2015 | E04G 11/50 |
| WO | WO-2017003004 | | * | 1/2017 | E04G 11/48 |
| WO | WO-2019190078 | A1 | * | 10/2019 | E04G 11/48 |

* cited by examiner

MOUNTING HEAD WITH ANCHORING CROSS-MEMBER AND CEILING FORMWORK SYSTEM CONNECTED THERETO

FIELD OF THE INVENTION

The invention relates to a mounting head as it is used on a vertical support for supporting a ceiling formwork panel for concrete pouring purposes. The invention also relates to a ceiling formwork system made up of ceiling formwork panel, mounting head and vertical support with connected anchoring element.

BACKGROUND OF THE INVENTION

Ceiling formwork systems are generally used in the construction of concrete ceilings for buildings with which a holding area for fluid concrete is created. This is to form the desired ceiling structure after curing. At this point with ceiling formwork systems having formwork elements or panels mounted on vertical supports, it is problematic that forces directed horizontally on the vertical supports or the formwork elements can have an effect which may result in a tilting of the entire ceiling formwork system, and in the worst case scenario result in it tipping over.

In order to counteract this problem, it is known to provide clamping connections for the ceiling formwork panel between the ceiling formwork panel and the existing structure. As a rule, these horizontal loads in the formwork plane are diverted via tensile members running at an angle and anchored, for example, to the ground. At its opposite end, they are affixed to the vertical support or to the mounting head on which the ceiling formwork panel is supported. An anchoring system for ceiling formwork panels according to this model is demonstrated and explained in reference to DE 10 2007 008 209 A.

However, this design also necessarily results in stress at points on the formwork panel, specifically where the vertical support engages the panel, which stress must be taken into account in the dimensioning of the formwork. Also, the previously known anchoring options allow only relatively small forces.

SUMMARY OF THE INVENTION

The object of the present invention is to improve a ceiling formwork system in order to be able to apply as much force with as little effort as possible to a panel for bearing horizontal loads.

The core concept of the invention is to gather and collectively divert horizontally occurring loads.

From the equipment technology perspective, a mounting head is conceived by the invention as it can be used for a vertical support to support a ceiling formwork panel, but which, in contrast to the prior art, has an anchoring cross-member which in the mounted state on the vertical support is aligned transverse thereto. The length of the anchoring cross-member corresponds to at least one side length of the ceiling formwork panel to be supported. In this way, the anchoring cross-member can engage at its respective ends on both lateral edges of the ceiling formwork panel, whereby the anchoring cross-member therefore simultaneously engages at two spaced-apart points in order to support and relieve the stress from the ceiling formwork panel. In other words, horizontal loads over the said side length of the ceiling formwork panel—that is, in its transverse or longitudinal direction—can be gathered via the mounting head according to the invention in order to then divert them in toto via the anchoring cross-member. In this way even greater horizontal loads can be borne compared to existing solutions.

Because only a single anchoring element, such as an anchoring chain or an anchoring belt, is also needed for a single anchoring cross-member, even fewer anchoring elements for an equal number of formwork panels are needed compared to the prior art. Whereas in the prior art there was anchoring at two points, respectively, it is possible by means of a single anchoring cross-member according to the invention for there to be anchoring at these two points simultaneously via a single anchoring element. Moreover, the solution according to the invention of the new mounting head with anchoring cross-member also provides a faster assembly, because it is no longer necessary for there to be anchoring at each support point.

The vertical force resulting when there is a diagonal relief of a ceiling formwork panel is absorbed by a vertical support which carries the mounting head. An introduction of vertical loads into the ceiling formwork system is thus fully compensated. The forces gathered by the anchoring cross-member at two points of the ceiling formwork panel are collectively absorbed and removed at the anchoring point, i.e. the connection point between mounting head and vertical support, whereby the total vertical load is borne via the vertical support directly at the point where it occurs. Thus, an individual support of the ceiling formwork panel at its two corner points can be eliminated and replaced by the single support via an individual vertical support centered on the anchoring cross-member.

The ceiling formwork system according to the invention thus comprises at least one formwork panel having at least one vertical support supporting the formwork panel and having an above-described mounting head and means for affixing the anchoring element. To hold the anchoring cross-member, i.e. to affix the two ends of the anchoring cross-member to the formwork panel, the formwork panel has respective latching recesses, so that, when the anchoring cross-member is held in the formwork panel, a tensile stress can be applied to the formwork panel by means of the anchoring element via the cross-member in order to thereby at least partially horizontally divert the applied load in the formwork plane.

The length of the anchoring cross-member of the mounting head is adapted to a side length of the formwork panel with respect to its length or its width. The anchoring cross-member is held in the center of the mounting head, the anchoring element in the form of a chain or a belt, etc. likewise engaging in the center of the anchoring cross-member according to an advantageous embodiment, so that the mounting head has the means for affixing the anchoring element.

In an advantageous embodiment, the mounting head may then be affixed to the vertical support and carried by it via a flange. In order to facilitate an alignment between the mounting head and the vertical support and to affix them by means of a flange connection, the mounting head can have an alignment element in the form of a pin, which for the alignment can protrude into a hollow end of the vertical support.

With regard to affixing the anchoring cross-member on the formwork panel, the formwork panel in an advantageous embodiment has a perimeter frame in which latching recesses are provided as openings on opposing sides for receiving the cross-member ends. Because the anchoring cross-member must be slightly longer than the exact side length of the panel in order to securely hold the formwork panel, the said opening exists as a latching recess in the form of an oblong hole, so that the anchoring cross-member is first inserted from underneath the formwork panel into the one latching opening, then the anchoring cross-member can be angled in a parallel plane to the formwork panel in order to introduce the second end of the anchoring cross-member into the second latching recess opening. With a relief of the anchoring cross-member tension, it is then brought into an abutment position in the latching recess openings.

In order to prevent a displacement of the anchoring cross-member along its longitudinal axis following its reception into the latching recess openings, the anchoring cross-member in an advantageous embodiment has two latching clips projecting at a right angle to the anchoring cross-member axis.

They are both advantageously provided with a distance apart from each other at the same end of the anchoring cross-member, so that between them an accommodation of a frame section of the formwork panel is possible, the shape and the size of the exterior latching clip being selected such that only in a specific position relative to the latching recess which is complementary in shape and size is it introducible into said recess. If the anchoring cross-member at this end is then inserted with the latching clip through the latching recess, then, when the anchoring cross-member is turned about its longitudinal axis, it turns out that this outer latching recess is co-rotated, whereby it can no longer be routed back through the latch opening, and the latching recess thus forms an abutment against the frame element. Thus, a translational displacement of the anchoring cross-member along its longitudinal axis, and specifically toward the inner side of the panel, is no longer possible.

The second latching clip, which abuts the inner side of the frame section of the frame of the formwork panel, forms an inhibition of the translational displacement of the anchoring cross-member along its longitudinal axis in the opposite direction. The second, inner latching clip may be of any shape and dimension, because it must not be routed through the latching recess opening in any case.

However, according to an advantageous embodiment, the latching clips are of identical design and are arranged offset with respect to the longitudinal axis of the anchoring cross-member at its outer perimeter. As a result, the anchoring cross-member can be inserted with both latching clips into and through the same latching recess opening when turned appropriately. This can make it easier to introduce the opposing end of the anchoring cross-member into the complementary latching recess opening. The larger the length of the anchoring cross-member relative to the associated side length of the formwork panel, the easier this is.

As was already indicated above, the mounting head is settable in an advantageous embodiment via a flange on the vertical support.

Finally, the ceiling formwork system according to an advantageous embodiment has a turnbuckle on the anchoring element in order to apply and adjust a tensile stress between anchor point and mounting head via the anchoring element.

If a formwork panel of the aforementioned type is configured in such a way that it is coupleable to further formwork panels via their end faces, it is possible to anchor a plurality of formwork panels using a single mounting head and an anchoring cross-member connected thereto, so that the anchoring force applied via an anchoring element of a single formwork panel is transferable to the formwork panels present in the force direction.

Additional details and further advantages of the invention are described below on the basis of an embodiment, which, however, should not be read as a limitation of the present invention; the same applies with regard to the accompanying drawing figures.

DETAILED DESCRIPTION

Figure 1:
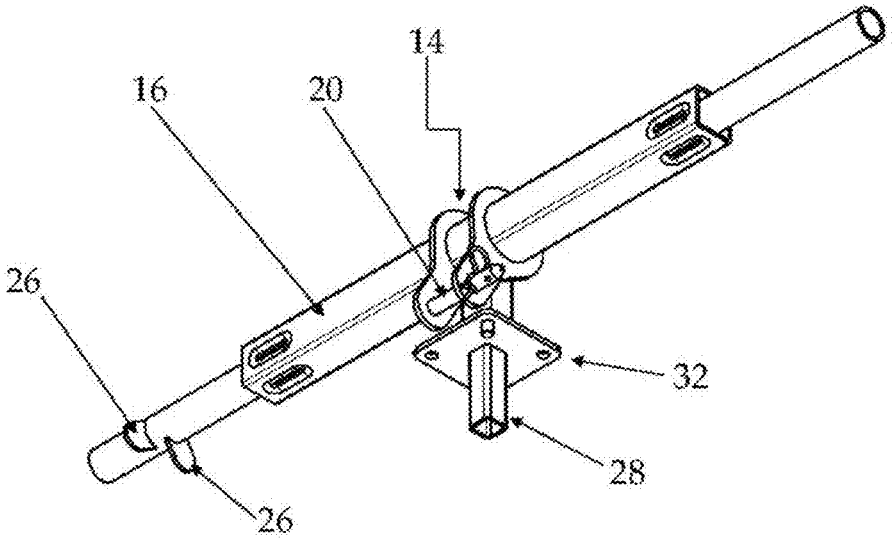
FIG. 1 is a perspective view of the mounting head according to the invention.
Figure 2A:
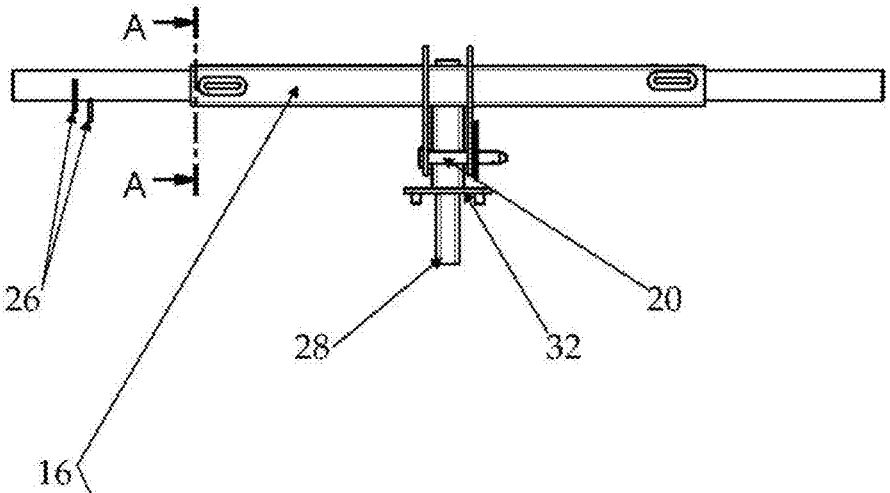
FIGS. 2A-D are a front view and a top view of the mounting head from FIG. 1.
Figure 2B:
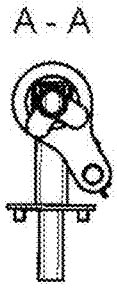
Figure 2C:
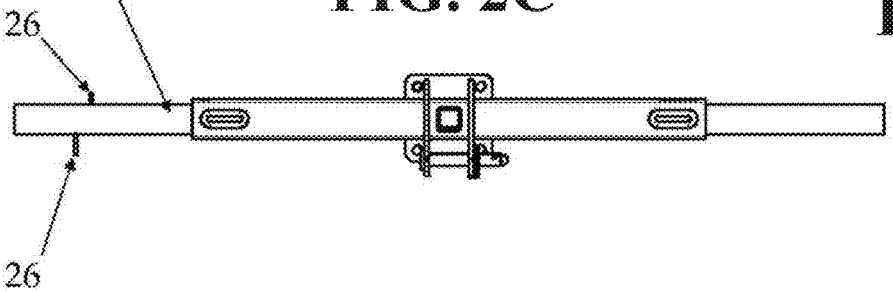
Figure 2D:
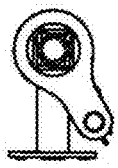

FIG. 1 shows the bearing head 14 according to the invention in perspective view. It has an anchoring cross-member 16, the length of which roughly corresponds to a side length of a formwork panel 10, i.e. projects somewhat past it in order to securely affix the ends of the anchoring cross-member to a frame 22 (see FIG. 4) of the panel. Normally, this is a perimeter frame of the panel.

In the present case, the anchoring cross-member is made of a round pipe, which for stability reasons is accommodated within a rectangular pipe and is solidly connected thereto, for example via welding. As a result, the anchoring cross-member has an optimal connection rigidity. This represents one embodiment. Of course, one skilled in the art understands that the anchoring cross-member can generally be made of a single rectangular pipe frame or, alternatively, a round pipe, or that a round pipe may be affixed, e.g. welded on, on both sides at a central rectangular pipe.

Transverse to the anchoring cross-member 16, an element of the mounting head projects downward, namely a mounting bracket, with which the mounting head 14 is placeable on a vertical support 12 (see FIGS. 3 and 4) and is fixable via a flange 32. By means of the mounting bracket and an alignment element 28, the anchoring cross-member 16 can easily be turned manually about its longitudinal axis (see the description for FIG. 5 for more details on this). The alignment element 28, which is recognizable below the flange, is used to facilitate affixing the mounting head within a hollow section of the vertical support.

Furthermore, means 20 for anchoring the mounting head, which are also referred to as, among other things, an anchoring eye, sit on the anchoring cross-member 16. These means, i.e. the anchoring eye, show two parallel plate elements that sit on the rectangular pipe frame and are connected by a pin. The anchoring element 18 (see, for example, FIG. 3 or 4) can be hooked in on this pin. The means 20 or, better put, the parallel plate elements can be turned about the longitudinal axis of the anchoring cross-member relative thereto, so that any angle of the anchoring element 18 relative to the anchoring cross-member can then be assumed for a fixation on the pin without the means 20 applying a torque to the rectangular pipe frame.

Figure 3A:
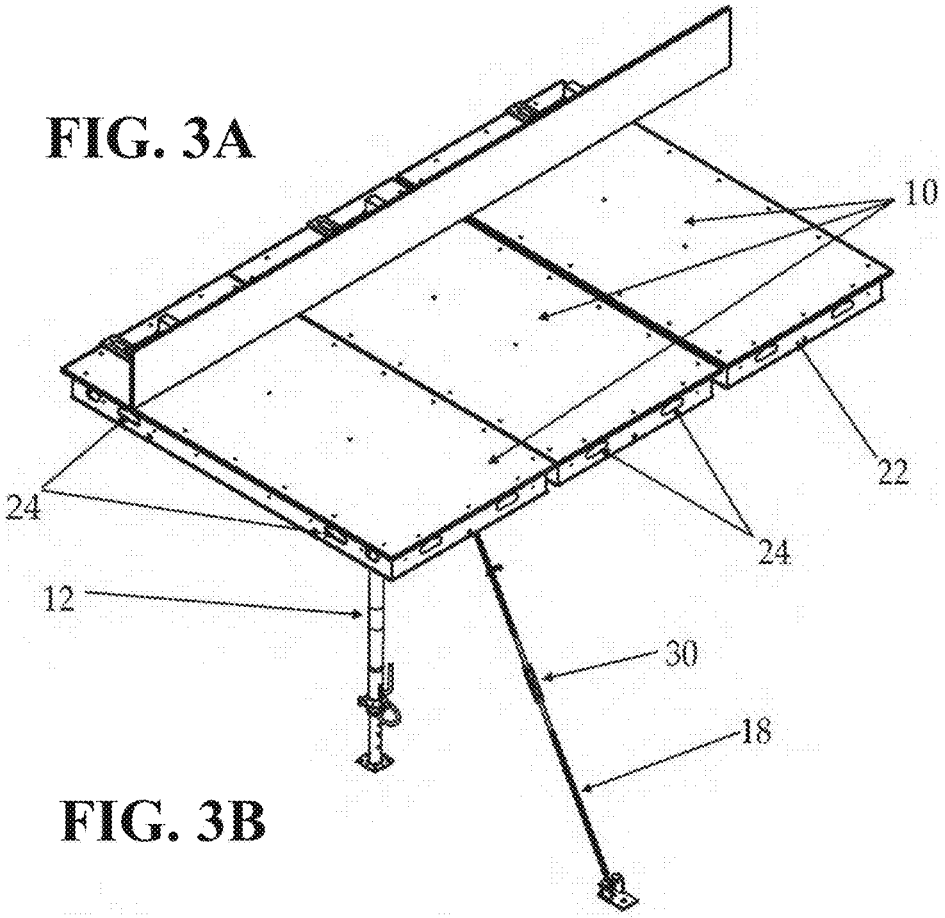
FIGS. 3A-B are relative perspective views from above and from below of the ceiling formwork system according to the invention.
Figure 3B:
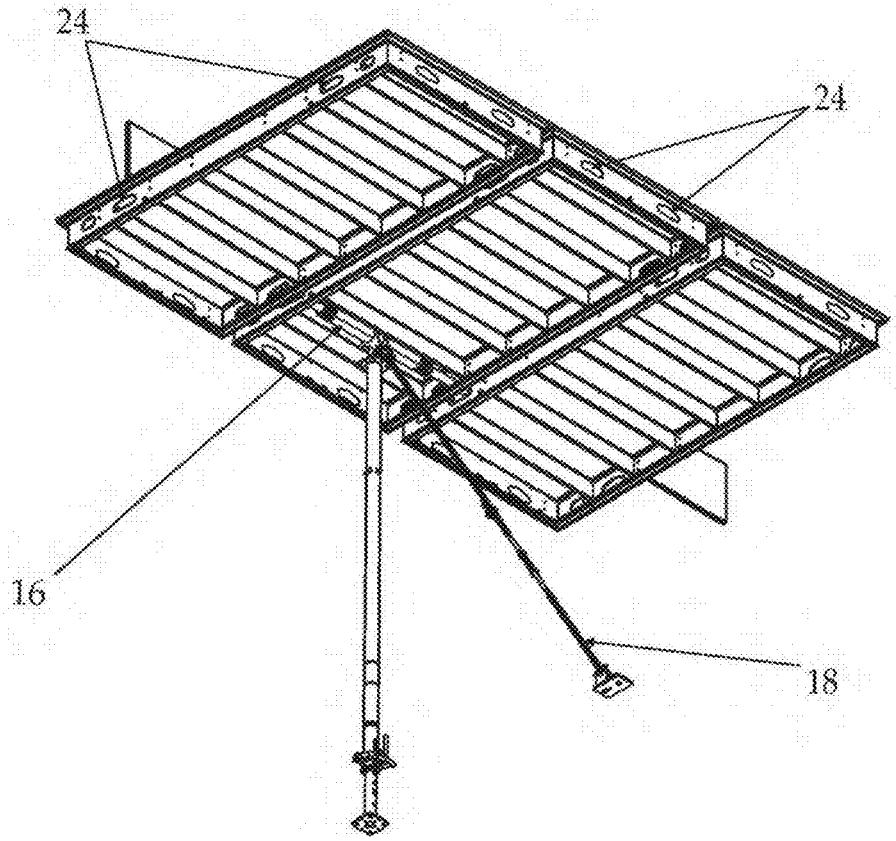
Figure 4:
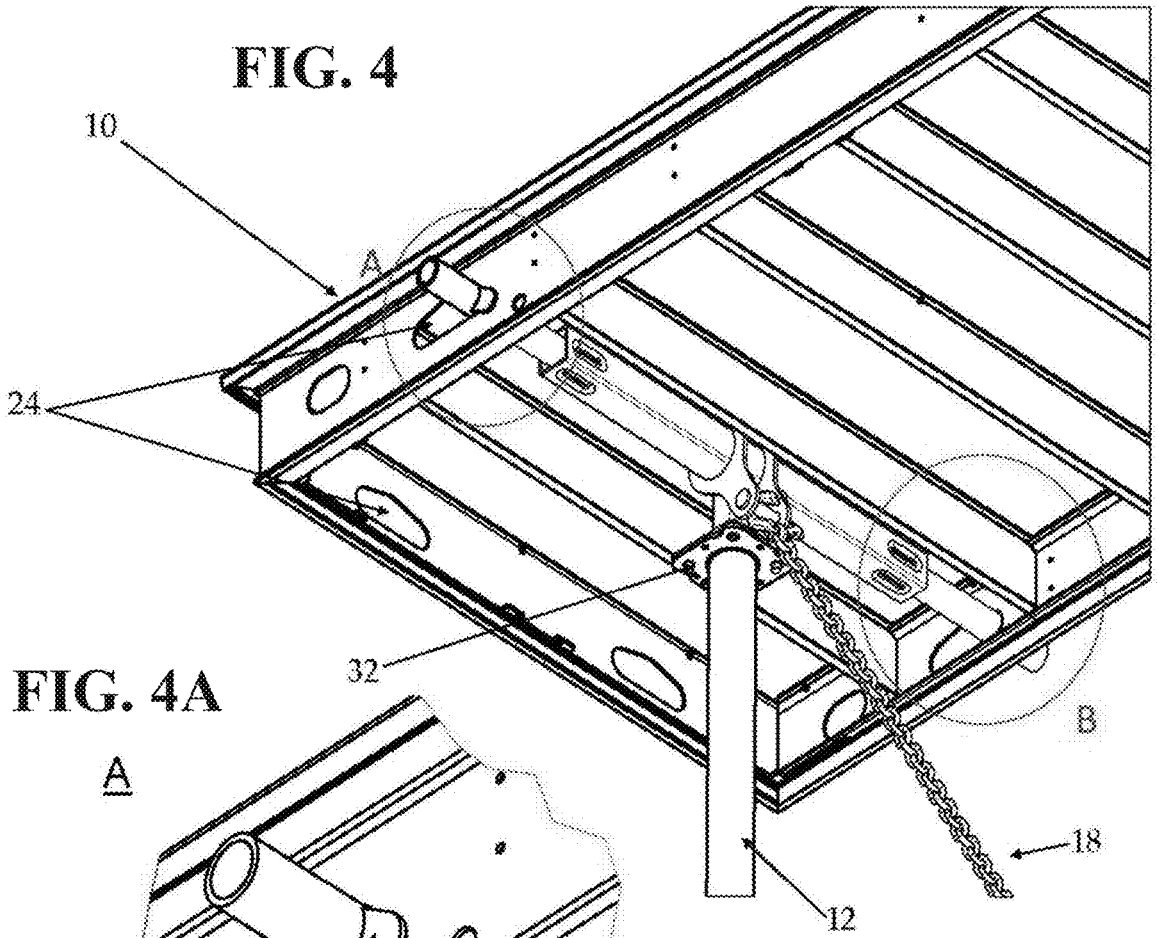
FIGS. 4-4B depict details of the ceiling formwork system from FIG. 3.

Two latching clips 26 are recognizable at one end of the anchoring cross-member 16, and each form an abutment in interaction with the frame of the formwork panel 10 (see e.g. FIG. 3) in order to inhibit a translational displacement of the anchoring cross-member 16 following a mounting on the formwork panel (see details about this in the description related to FIGS. 4 and 5).

FIGS. 2A-D shows the mounting head from FIG. 1 in a front view and a top view with respective section A-A. As can be recognized in the front view, the mounting bracket projects at a right angle downward from the anchoring cross-member 16, the alignment element 28 projecting below the flange 32. The latching clips 26 shown in the sectional view A-A of the front view are illustrated with broken lines because they are in front of the sectional plane.

FIGS. 3A-B show the ceiling formwork system according to the invention from formwork panel 10— more precisely, three formwork panels 10—a vertical support 12 supporting the central formwork panel and a mounting head 14 with anchoring cross-member 16 in a state of being mounted in the central formwork panel. The anchoring element 18 in the form of anchoring element can also be recognized. The latter is anchored on the ground by means of a fixation anchor (the ground is not illustrated in the drawing), and at the other end the anchoring chain is hooked in on the pin of the anchoring means 20. To tension the anchoring chain 18, a turnbuckle 30 is inserted therein with which the length of the anchoring chain can be varied, so that a tensioning force in the form of tensile stress can be applied to the mounting head 14 with anchoring cross-member 16.

A respective ceiling formwork element has a total of eight latching recesses 24, i.e. two latching recesses on each side length of the formwork panel. As a result, an anchoring cross member can be installed on each of the short sides over the width direction of the formwork panel, and a longer anchoring cross-member on the long sides of the panel. In other words, each formwork panel can be anchored in its width direction and/or in its longitudinal direction.

Said latching recess openings 24 are provided in the frame 22 of the formwork panel, which frame runs around the perimeter of the formwork panel. In FIG. 3 an anchoring cross-member is anchored over the width of the central formwork panel.

Figure 4A:
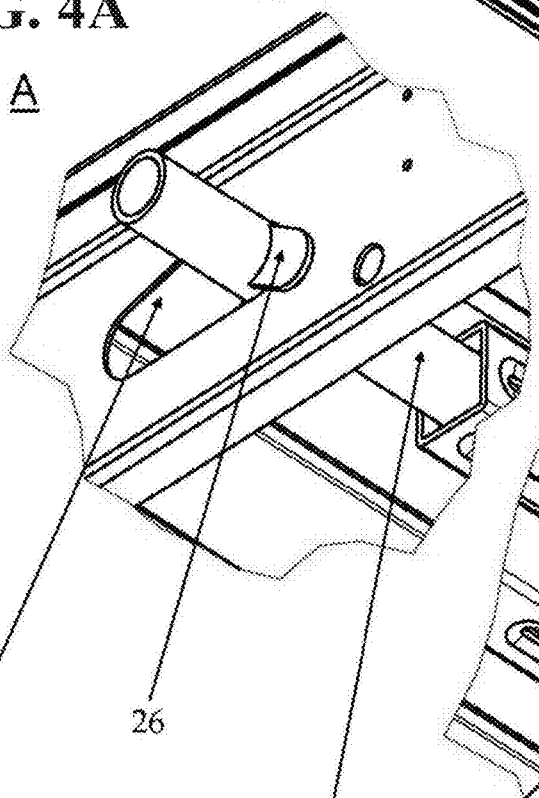
Figure 4B:
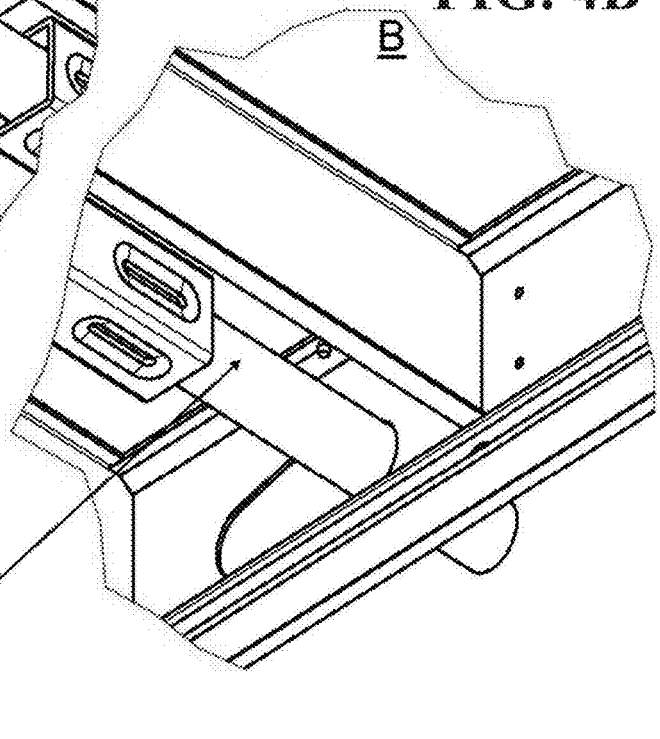
Figure 5A:
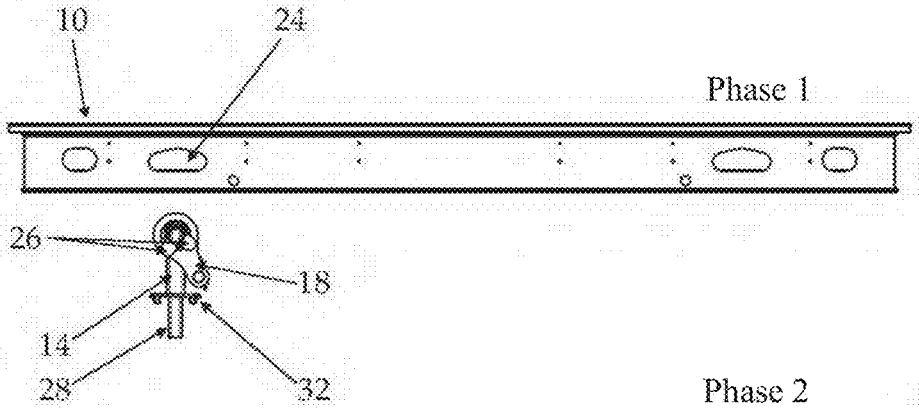
FIG. 5A-F depict phases of an assembly of the mounting head on the formwork panel.
Figure 5B:
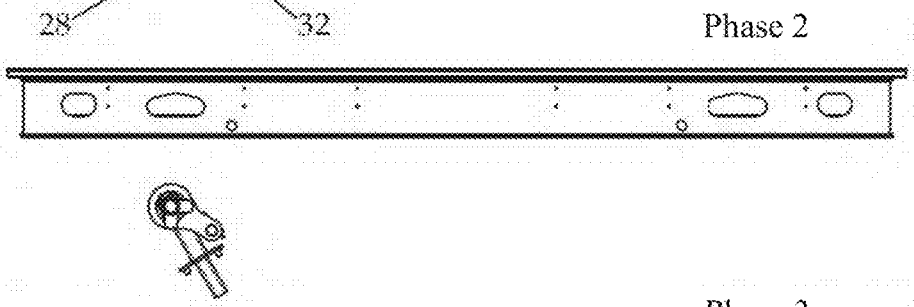
Figure 5C:
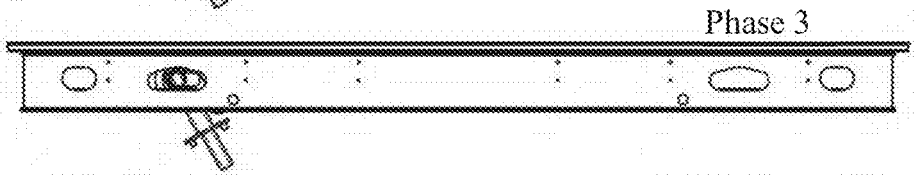
Figure 5D:
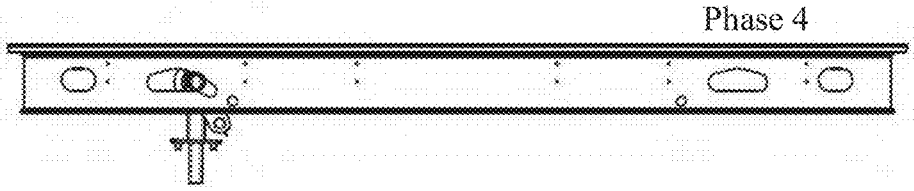
Figure 5E:
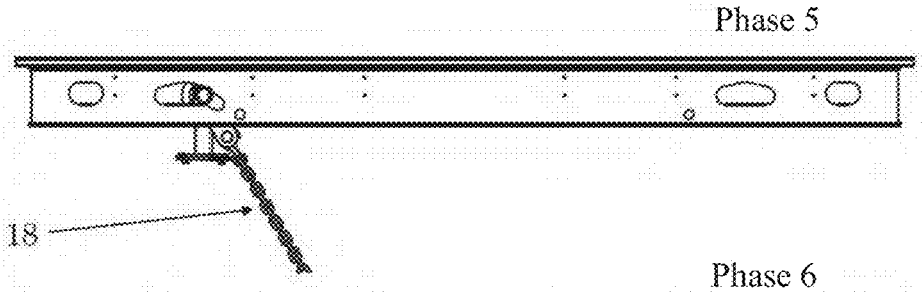
Figure 5F:
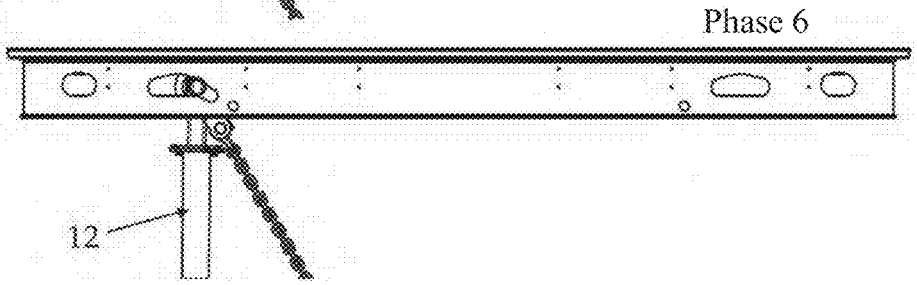

From FIGS. 4-4B, mounting details of the anchoring cross-member can be seen on the formwork panel, i.e. on its frame 22. As shown, the mounting head 14 with anchoring cross-member 16 is completely accommodated on the frame 22 of the formwork panel 10 and fixed via the latching clip 26 in such a way that a translational displacement of the anchoring cross-member 16 along its longitudinal axis in the perimeter frame 22 is inhibited. The respective latching recess 24 is formed by a triangular oblong hole. As a result the introduction of the anchoring cross-member 16 on the respective end is made easier. In other words, the anchoring crossmember can be swiveled in a plane parallel to the formwork plane of the panel, a pushing in of the anchoring cross-member 16 from within the frame 22 being easily possible as before thanks to the dimensioning of the latching recess opening 24.

The detail A (FIG. 4A) shows very clearly the abutment of the outer latching clip 26 against the outer surface of the frame 22 of the formwork panel 10. With the aid of the configuration of the two latching clips 26 (see FIG. 1), it can be determined that the inner latching clip 26 abuts the inner side, i.e. the inner surface of the frame 22 and the anchoring cross-member 16 is held by this abutment in such a way that they cannot be displaced outward through the latching recess opening 24 shown in Detail A. As a result, the anchoring cross-member 16 overall also cannot be displaced through the opposite opening, as shown in Detail B (FIG. 4B).

In FIGS. 5A-F, the phases 1-6 of a mounting of the mounting head with anchoring cross-member on the frame of a formwork panel are shown. To align the outer latching clip, the mounting head 14 is first tilted about the longitudinal axis of the anchoring cross-member 16 in such a way that the outer latching clip 26 can be pushed from the inner side of the frame 22 through the latching recess opening 24 associated therewith (see also phases 2 and 3). In phase 4, the mounting head 14 is swung back down, whereby the outer latching clip 26 is co-rotated in such a way that it can no longer be pushed back through the latching recess opening 24. Moreover, the other one, i.e. the inner latching clip, forms an abutment on the inner side of the frame surface so that the anchoring cross-member 16 can no longer be translationally displaced within the latching recess opening 24 along its longitudinal axis.

Subsequently, the anchoring element 18 in the form of an anchoring element can be hooked in on the means for anchoring, and a vertical support can be mounted via the flange connection 32 on the mounting head. The anchoring chain can then be affixed and tensioned there by means of a ground anchor, whereby as a result horizontal loads on the existing structure are borne in the anchored state of the ceiling formwork panel.

LIST OF REFERENCE CHARACTERS

10 Formwork panel
12 Vertical support
14 Mounting head
16 Anchoring cross-member
18 Anchoring element
20 Anchoring means
22 Frame
24 Latching recess
26 Latching clip
28 Alignment element
30 Turnbuckle
32 Flange

The invention claimed is:

1. A ceiling formwork system, comprising:

at least one formwork panel, at least one vertical support supporting the formwork panel, a mounting head having an anchoring cross-member, and means for affixing an anchoring element, the formwork panel having a respective latching recess for receiving a respective anchoring cross-member end, so that, when the anchoring cross-member is held in the at least one formwork panel via the anchoring element, a tensile stress can be applied via the anchoring cross-member to the at least one formwork panel in order to at least partially horizontally divert an applied load in the formwork plane, wherein the mounting head in the mounted state on the vertical support has the anchoring cross-member oriented transverse to the vertical support and having a length corresponding at least to a side length of the at least one formwork panel, whereby the anchoring cross-member can be affixed at each end to lateral edges of the at least one formwork panel.

2. The ceiling formwork system according to claim 1, wherein the means for affixing the anchoring element is attached to the mounting head.

3. The ceiling formwork system according to claim 1, wherein the formwork panel has a frame running around the perimeter in which the latching recesses are provided as openings on opposing sides of a panel frame for holding the cross-member ends.

4. The ceiling formwork system according to claim 3, wherein the anchoring cross-member has two latching clips projecting at a right angle to the cross-member longitudinal axis with which the anchoring cross-member can be latched on the frame in the latching recesses in such a way that in the latched state a translational displacement of the anchoring cross-member along its longitudinal axis is inhibited.

5. The ceiling formwork system according to claim 4, wherein the two latching clips are provided with a distance from each other at the same end of the anchoring cross-member, the shape and the dimension of at least the outer latching clip being selected such that in a specific position it can be passed through the latching recess, which is complementary in shape and dimension, and, when the cross-member is turned about its longitudinal axis, this latching clip is turned with it in such a way that it then forms an abutment against the frame element in order to inhibit the translational displacement of the anchoring cross-member along its longitudinal axis.

6. The ceiling formwork system according to claim 5, wherein the two latching clips are structurally identical in their dimensions and are arranged offset transverse to the longitudinal axis of the anchoring cross-member at its outer perimeter.

7. The ceiling formwork system according to claim 1, wherein the mounting head is securable to the vertical support via a flange.

8. The ceiling formwork system according to claim 1, wherein the anchoring element comprises a turnbuckle.

9. The ceiling formwork system according to claim 1, further comprising a plurality of formwork panels, which are coupleable to each other at their end faces, so that the force applied via an anchoring element of a formwork panel is transferrable to the formwork panels present in the force direction.

10. The ceiling formwork system according to claim 1, wherein the anchoring cross-member comprises a round pipe.

11. The ceiling formwork system according to claim 10, wherein the anchoring cross-member further comprises a rectangular pipe such that the round pipe is accommodated within the round pipe.

12. The ceiling formwork system according to claim 1, wherein the anchoring cross member is affixed at each end to lateral edges of the ceiling at least one formwork panel by a pair of latching clips disposed at one end of the anchoring cross member.

13. The ceiling formwork system according to claim 1, wherein the at least one formwork panel comprises at least one ceiling formwork panel including a frame.

14. A ceiling formwork system, comprising:

at least one formwork panel frame defining a latching recess;

at least one vertical support supporting the formwork panel; and a mounting head comprising a plurality of latching clips at one end configured to pass through the latching recess and engage with an outer surface of the at least one formwork panel frame.

15. The ceiling formwork system of claim 14, wherein the plurality of latching clips comprises:

an outer latching clip configured to engage with the outer surface of the at least one formwork panel frame; and an inner latching clip configured to engage with an inner surface of the at least one formwork panel frame.

16. The ceiling formwork system of claim 14, wherein the plurality of latching clips project from the anchoring cross-member at right angles.

17. A system, comprising:

at least one ceiling formwork panel including a frame defining latching recesses;

at least one vertical support supporting the at least one ceiling formwork panel; and a mounting head comprising an anchoring cross-member oriented transverse to the at least one vertical support when the mounting head is in a mounted state on the at least one vertical support, and having a length corresponding at least to a side length of the at least one ceiling formwork panel, whereby the anchoring cross-member can be affixed at each end to lateral edges of the at least one ceiling formwork panel, wherein the anchoring cross-member has two latching clips projecting at a right angle to the anchoring cross-member longitudinal axis with which the anchoring cross-member can be latched on the frame in the latching recesses in such a way that in the latched state a translational displacement of the anchoring cross-member along its longitudinal axis is inhibited.

* * * * *